United States Patent [19]

Williamson

[11] 3,967,539

[45] July 6, 1976

[54] VARIABLE STROKE FLUID CYLINDER

[76] Inventor: Robert E. Williamson, 446 Caldwell St., Bradner, Ohio 43406

[22] Filed: Nov. 20, 1974

[21] Appl. No.: 525,361

[52] U.S. Cl. ..... 91/404; 91/468; 92/161; 92/165 R

[51] Int. Cl.[2] ..... F15B 13/042; F15B 15/24

[58] Field of Search ..... 91/404, 468; 92/165 R

[56] References Cited

UNITED STATES PATENTS

| | | | |
|---|---|---|---|
| 2,587,182 | 2/1952 | Livers | 91/404 |
| 2,606,414 | 8/1952 | Dyrr | 91/404 |
| 2,606,532 | 8/1952 | Ziskal | 91/404 |
| 3,667,347 | 6/1972 | Patrick | 91/404 |

*Primary Examiner*—Paul E. Maslousky
*Attorney, Agent, or Firm*—Vincent L. Barker, Jr.

[57] ABSTRACT

An adjustable stroke length fluid cylinder used to move agricultural or industrial machinery is disclosed. The cylinder is an enclosed unit having a movable piston therein which is attached to an axial piston rod secured to the load. A fluid valve directs the application of pressure fluid to either side of the piston to extend or retract the piston rod. One end of the cylinder houses a head unit containing an internal valve which is operated by a stop member positioned on the piston rod. The internal valve is effective to stop retraction of the piston rod when actuated by the stop member by blocking fluid flow through the cylinder. Subsequent extension of the piston rod automatically returns the internal valve to its open position.

3 Claims, 3 Drawing Figures

VARIABLE STROKE FLUID CYLINDER

BACKGROUND OF THE INVENTION

Countless agricultural and industrial apparatus utilize hydraulic piston and cylinder devices to move machinery sections or to position a portion of the apparatus near the work surface, etc. Agricultural and construction machinery in particular requires such devices to be sturdy, trouble-free and without complex electrical or fluidic control devices which are not suitable for rough use or field service. In many cases, the space available for the cylinder is an important factor which further increases the need for a rugged, compact and maintenance-free hydraulic device. Many installations require that the stroke of the piston, and thus the position of the load, be adjustable in the field. While many complex hydraulic or electrical devices are capable of programming a fluid operated cylinder, their cost and complexity make them unsuitable for many installations and unsuitable for field adjustment or servicing by the machinery operator.

This invention relates to a fluid pressure cylinder having an adjustable stroke length for use in moving agricultural or other industrial machinery components. More particularly, the invention is suited for use with a double-acting hydraulic cylinder used on agricultural or industrial machinery in which the cylinder is secured to the frame of the machinery and the reciprocating piston is secured to and operates a movable load, such as a harvesting mechanism, moving blade, etc. The invention is particularly suited for this purpose in that it provides a cylinder of minimum dimensions and external components which can be readily and simply adjusted to position its load at a predetermined position by means of a self-contained valve mechanism built into the head of the cylinder.

BRIEF SUMMARY OF THE INVENTION

The invention includes a cylinder having a fluid tight sleeve, closed at one end with the other open end closed by a co-axially fitting head member. A reciprocating piston within the sleeve is secured to a piston rod which extends axially through the head member so that reciprocation of the piston due to changes in fluid pressure applied thereto will reciprocate the piston rod, and thus the load attached to it. The cylinder is double-acting in that it is designed to receive fluid under pressure applied to either face of the piston. Appropriate fluid connections are provided such that the fluid flows in a closed path through a closed system when the piston is being moved in either direction.

A novel feature of the present invention is the provision of a self-contained adjustable stop mechanism which is built into the cylindrical cylinder head. The cylinder head includes a pair of spaced apart, circumferential grooves which act as fluid passages within the closed fluid system. Intersecting with both of these grooves is an axial passage containing a fluid valve which, when in closed position, will interrupt the flow of fluid through the system and thus stop the movement of the piston and its rod when the valve is closed. The valve is moved from its open and closed position by an actuator which extends through the valve passage outwardly of the head and is contacted by an adjustable stop on the piston rod or other moving member. The valve is so positioned that, when fluid is flowing in the reverse direction to extend the piston rod, it automatically will open the valve. Accordingly, the invention provides a fluid cylinder whose extended position is constant, that is, it is limited by the amount of movement of the piston within the cylinder. Its retracted position is determined by the point at which the valve is closed to interrupt fluid flow. This point is selected by the operator by adjusting the external stop member to the predetermined position. The stop valve is automatically returned to its open position by extension of the piston rod to be ready for the subsequent retraction.

It is accordingly an object of this invention to provide a fluid cylinder of adjustable stroke length which includes an automatic stop valve built within the cylinder head which is effective to stop movement of the retracting piston at a predetermined position set by the operator.

It is another object of this invention to provide an adjustable stroke length fluid cylinder in which the mechanism for stopping the movement of the piston at the desired position is built entirely into the cylinder and does not rely on external relays, limit switches, or other devices.

It is a further object of this invention to provide a double-acting hydraulic cylinder having a variable stroke retraction selected by the operator by a simple adjustment of a stop member external of the cylinder and in which the operating valve to stop the cylinder at the predetermined position is fully contained within the cylinder itself and is automatically reset on each cycle.

Other objects and advantages of the invention will be apparent to those skilled in the art from the following description of the preferred embodiment thereof, with reference being made to the accompanying drawings.

DETAILED DESCRIPTION

Figure 1:
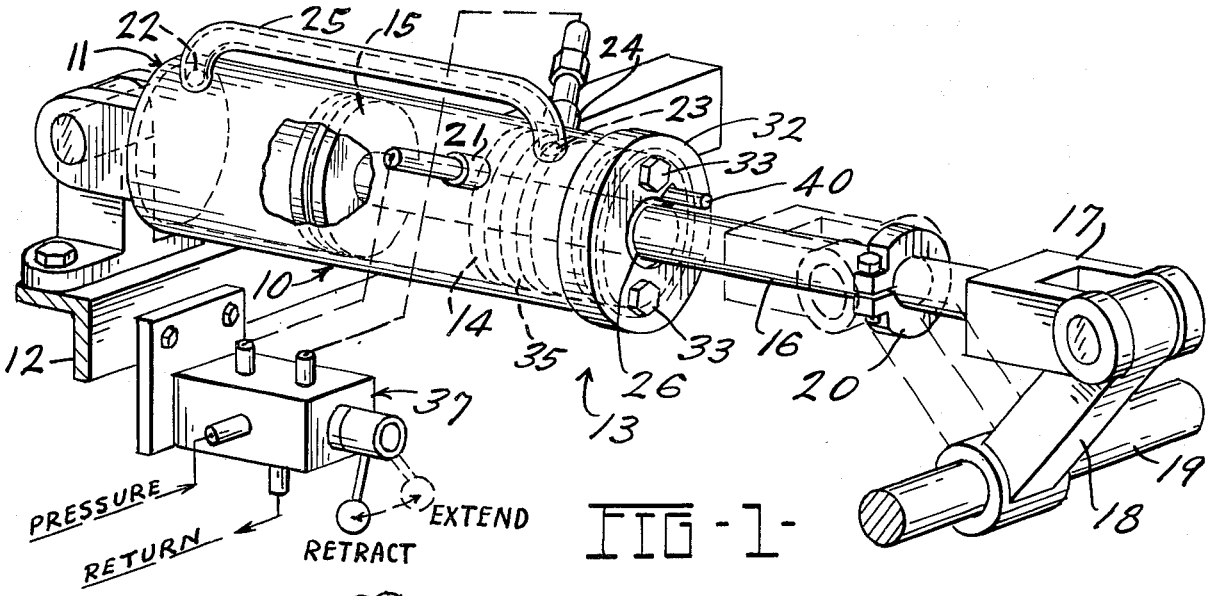
FIG. 1 is a view in perspective of the variable stroke cylinder of this invention, showing it as it would be installed upon an operating piece of machinery and schematically indicating the connection from a pressurized fluid reservoir through an operating valve.

Referring first to FIG. 1, the fluid cylinder of this invention is shown in a typical manner in which it would be connected for use in operating agricultural or industrial machinery. The cylinder includes an external sleeve 10 having a closed end 11 pivotally secured to the frame 12 of the machine. The other open end 13 of the sleeve 10 contains a co-axially fitting internal head 14 which will be particularly described below with reference to FIGS. 2 and 3. Between the two ends 11 and 13 of the sleeve 10 is a piston 15 having conventional rings or seals on its periphery for reciprocation within the sleeve 10. Secured to and extending from the piston 15 is a piston rod 16 which extends co-axially through the head 14 and out of the sleeve to a yoke 17 or other suitable connection member. The yoke 17 is shown as pivotally attached to a crank arm 18 which is secured to a load shaft 19. As clearly seen from FIG. 1, movement of the piston 15 within the sleeve 10 by fluid pressure in either direction will cause reciprocation of the piston rod 16 and accordingly will drive the crank arm 18 and load shaft 19 which is connected to the work load.

An adjustable stop member 20, which is shown in this illustration as a split ring clamp and set screw, is placed upon the piston rod 16 and can be moved along the axis of the piston rod 16 to the desired position as will be explained below. The sleeve 10 of the cylinder has a first fluid inlet or opening 21 extending through its wall generally adjacent the innermost face of the head 14. A second fluid opening 22 extends through the wall of the sleeve at a position adjacent the closed end 11. A third fluid opening 23 extends through the sleeve 10 adjacent the area of the head 14 and a fourth fluid opening 24 extends through the sleeve wall adjacent the area of the head and axially spaced from the third opening 23. An external pipe 25 is shown connecting the second fluid opening 22 with the third fluid opening 23. The passage provided by the pipe 25 could be formed in the wall of the sleeve 10 if desired.

Figure 2:
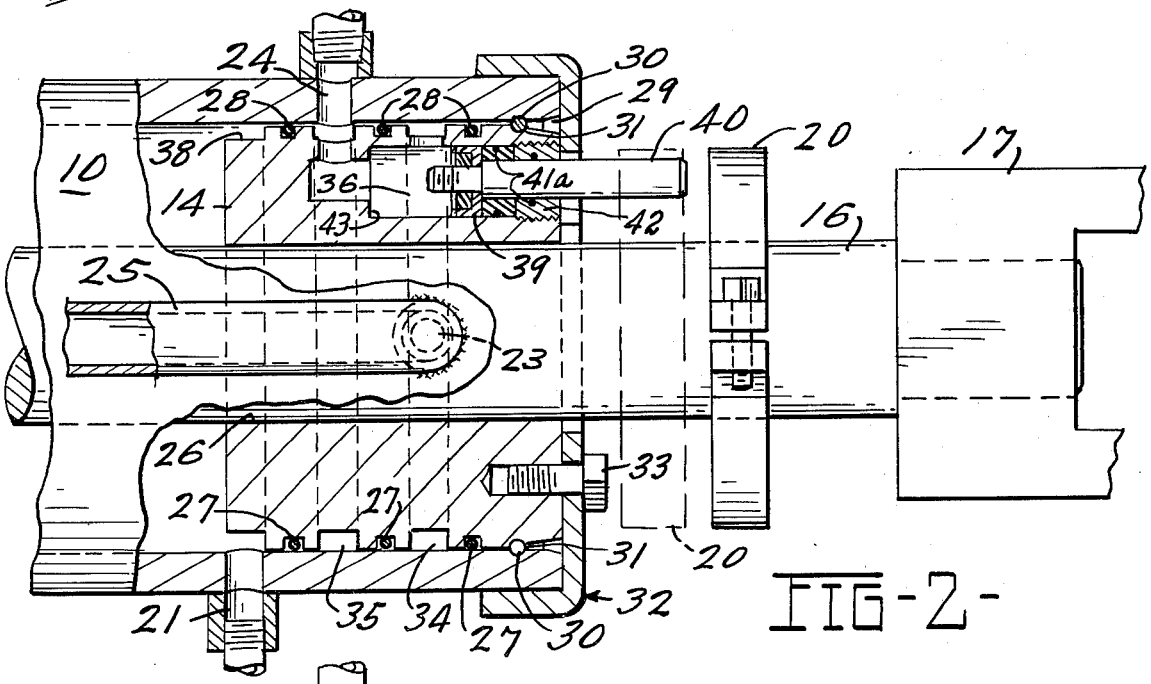
FIG. 2 is a view in cross section of the head end of the cylinder shown in FIG. 1, showing the details of the valve mechanism with the valve shown in open position.

Referring to FIG. 2, the head 14 is a cylindrical plug whose outside diameter is adapted to closely fit within the open end 13 of the sleeve 10. Its internal axial bore, designated by reference numeral 26, closely receives the piston rod 16 and may be provided with appropriate seals, etc., of a conventional nature so that hydraulic fluid will not pass therebetween when the piston rod 16 is moving through the bore 26. The outer periphery of the head 14 may be provided with one or more (three are shown) annular grooves 27 containing a resilient seal, such as an O-ring 28 which effectively seals the mating surfaces against fluid leakage. The outermost edges of the sleeve 10 and head 14 are tapered away from each other, in the area indicated by reference numeral 29, with an internal land 30 extending about the periphery of each member at the innermost portion of the tapered area 29. Within the space formed by the annular lands 30, a snap ring 31 or equivalent device is placed to prevent removal of the head 14 from the sleeve 10. Finally, a flanged cap 32 is secured over the exposed ends of the head 14 and sleeve 10 and held in place by a pair of machine bolts 33, best seen in FIG. 1.

The internal construction of the head 14 forms an important part of the invention and is as follows. A first annular passage or groove 34 extends around the periphery of the head 14 and is positioned in alignment with the third fluid opening 23 through the sleeve, as seen in FIG. 2. A second annular passage or groove 35 extending around the periphery of the head 14 is spaced from the first passage 34 and is in alignment with the fourth fluid opening 24 through the sleeve 10, as seen in FIG. 2. A third fluid passage 36 extends in an axial direction into the head 10 and is positioned to intersect the first and second annular passages 34 and 35. Accordingly, as thus far described, fluid flowing in the pipe 25 is in communication with the first passage 34 through the third opening 23, which connects with the third passage 36, which in turn connects with the second annular passage 35 which in turn is in communication with the fourth opening 24.

Referring again to FIG. 1, fluid supply lines are schematically shown as connected from a reversing operating valve, generally designated by reference numeral 37, so that fluid may pass between the valve 37 and the first opening 21 and between the valve 37 and the fourth opening 24. With the valve positioned as shown in the "retract" position, fluid will flow in the direction of the broken arrows from the fluid reservoir, through the valve 37, and into the cylinder through the first opening 21. As best seen in FIG. 2, fluid entering the sleeve 10 through the first opening 21 passes into the cylinder alongside the inner edge of the head 14 through an annular relieved area 38. This fluid under pressure will force the piston 15 to the left, as it is shown in FIG. 1. Fluid in the cylinder to the left of the piston 15 is evacuated from the sleeve 10 through the second opening 22, through the pipe 25, and into the sleeve 10 through the third opening 23. Entering through the third opening 23, fluid enters the first passage 34 in the head, flows through the third passage 36 to the second annular passage 35, and out of the sleeve 10 through the fourth opening 24 and back to the valve 37 and reservoir. It will be understood by those skilled in the art that movement of the valve 37 to its "extend" position will reverse the fluid flow through the previously described openings and passages to reverse the movement of the piston 15 so that it moves to the right as shown in FIG. 1.

Referring again to FIG. 2, a stop valve 39 is slidably positioned within the third fluid passage 36 and has an actuator pin 40 extending outside of the head 14 and through an aperture in the flanged cap 32. The valve 39, which may have a resilient seat secured to a reduced diameter portion of the actuator pin 40, is guided by a bearing 41 which is held in position by a plug 42 turned into the outermost portion of the third passage 36. O-rings 41*a* may be carried in the bearing and in the plug to prevent any fluid leakage.

Figure 3:
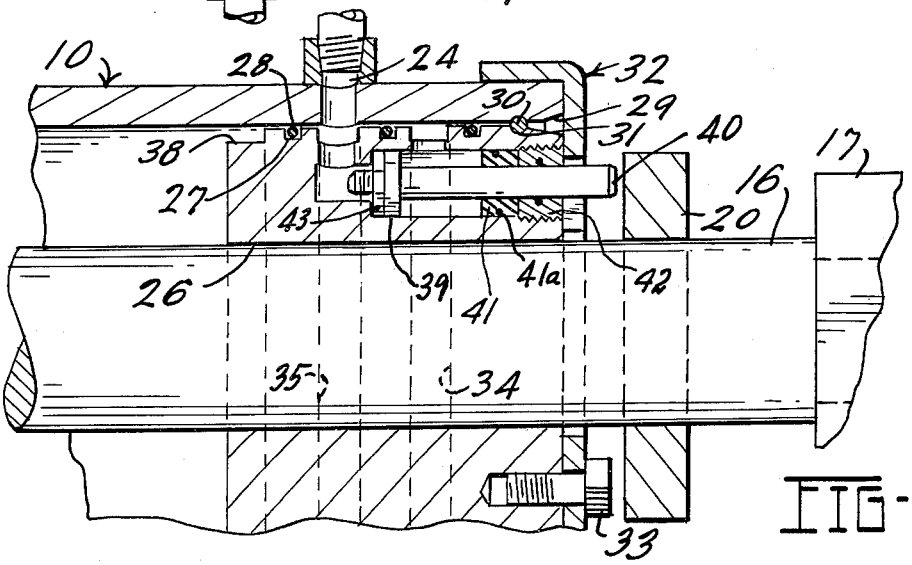
FIG. 3 is a cross sectional view in part, similar to FIG. 2, and showing the valve in the head in closed position.

As seen in FIGS. 2 and 3, the stop valve 39 is movable from an open position, as shown in FIG. 2, to a closed position, shown in FIG. 3, in which position the head of the stop valve 39 rests against a seat 43 provided by a reduced portion of the third fluid passage 36. Furthermore, as shown in FIG. 2, when the valve 39 is in its open position, it lies to the right of the first annular fluid passage 34 in the head and is thus essentially removed from all fluid flow through the system. As will be seen clearly from FIG. 3, when the valve 39 is in its closed position, it completely blocks the passage 36 so that no fluid can flow from the first passage 34 in the head to the second passage 35 in the head.

By means of the stop member 20, the operator can adjust the position at which the piston will stop during its retraction stroke. FIG. 2 shows the valve 39 in open position with the stop member 20 positioned on the piston rod 16 about to strike the outermost end of the valve actuator 40. Continued retraction or movement to the left of the piston rod 16 will move the actuator 40 and thus the head of the valve 39 from its open position to the left into the flow of fluid. Because the fluid is flowing from the first passage 34 through the third passage 36, it will quickly apply pressure to the head of the valve 40, causing it to snap into its closed position and will hold it there, as shown in FIG. 3. When the valve 39 has moved to its FIG. 3 closed position, no more fluid can flow through the system and thus there is no pressure release for the space within the cylinder behind the piston 15. This will effectively stop the piston's retracting movement at the point where the valve is closed.

When the operator moves the reversing valve 37 to its extend position, fluid flow from the reservoir to the cylinder is in the opposite direction from the broken line shown in FIG. 1. Thus, fluid under pressure enters the sleeve 10 through the fourth opening 24 and pressure is applied to the face of the valve 39. At the same time, pressure is released in the area above the piston 15 so that it starts to move to the right as shown in FIG. 1, thus moving the stop member 20 to the right away from the actuator 40. Fluid pressure on the valve 39 will cause it to move from its closed position to that of its open position in FIG. 2 so that the piston 15 and rod 16 will move to their fully extended position and the valve 39 is automatically returned to its open position. The piston will finally stop when it reaches the termination of its movement and abut against the inner face of the head 10. The cycle is now complete so that manually moving the reversing valve 37 to retract will again start the cycle as previously described.

It will be seen from the above detailed description of the preferred embodiment of this invention that a simple valving system which is self-contained within the sleeve 10 of the cylinder itself is effective to stop the piston rod 16 at any predetermined retracted position, as determined by the manually set position of the stop member 20 on the piston rod 16. It is to be understood that the design of the stop member 20, its method of graduation or positioning does not constitute an important part of this invention. However, using the head and self-containing valve of the type described, a cylinder having a minimum of external parts may be used to selectively adjust the retracted position of the work load and which the valve is returned to its previous condition upon extension of the piston rod 16, without the necessity of reset switches, or other complex devices.

Various modifications of the above-described preferred embodiment of this invention will be apparent to those skilled in the art and may be made without departing from the scope of this invention, as defined by the following claims.

I claim:

1. A double acting hydraulic cylinder having a piston and rod movable from a fully extended position to a variable retracted position, comprising, in combination, a cylindrical sleeve closed at one end, a cylindrical head coaxially and removably secured within the other end, a piston positioned for reciprocation within the sleeve between the one closed end and the head, a piston rod secured to the piston and extending axially through the head so as to reciprocate with the piston, a stop member adjustably secured to said piston rod, said cylindrical head including first and second external grooves defining, with the interior sleeve surface, first and second passages, an axial bore within said head communicating with each of said passages, and a valve member positioned in the bore with a stem extending beyond said head and movable between an open position wherein the passages are in communication and a closed position wherein the passages are isolated from each other, and said sleeve further including a first connection adjacent the head and leading to an external fluid source for applying fluid pressure to the side of the piston adjacent the head, a second connection adjacent said one closed end of the sleeve, a third connection in communication with said first external groove in the head, a fluid line connecting said second and third connections, and a fourth connection in communication with said second external groove in the head and leading to an external fluid reservoir, whereby, when said valve member is in the open position, pressurized fluid from the external source can flow into the first connection to retract the piston and rod, sequentially moving fluid outwardly through the second connection, through said fluid line and into the third connection, through said first passage and said axial bore to said second passage, and out the fourth connection, and whereby, when said valve member is moved to closed position by said stop member on said retracting piston rod, outward fluid flow through the second connection is stopped, thereby preventing further movement of the piston and rod.

2. The hydraulic cylinder of claim 1 wherein said first and second external grooves in the head are circumferentially disposed in the external surface of the head in parallel, spaced relationship, and which includes first and second sealing means comprising annular sealing rings positioned circumferentially between the head and the sleeve, at least one of the rings being between the first and second external grooves.

3. In a variable stroke, double acting hydraulic cylinder having a control means for regulating the length of the stroke, such control means including an axially movable valve with an actuator positioned for engagement by a stop member connected to the piston rod of the cylinder when the piston and rod are in a retracted position, the improvement comprising a cylindrical head member coaxially and removably secured within an end of the cylinder and sealingly positioned about the piston rod, said head member including first and second external grooves defining, with the interior surface of the cylinder, first and second fluid passages, both of said grooves being in communication with a bore in the head within which such valve is movable between an open position connecting said passages and a closed position isolating said passages, said closed position corresponding to the retracted position of the piston and rod, said first external groove further being in fluid communication with the interior of the cylinder on the opposite side of the piston from the rod and said second external groove further being in fluid communication with an external fluid reservoir, and sealing means between the exterior surface of the head and the interior surface of the cylinder for separating said first and second passages and for preventing fluid leakage between the head and the cylinder.

* * * * *